US009265979B2

(12) United States Patent
Lenz, Jr. et al.

(10) Patent No.: US 9,265,979 B2
(45) Date of Patent: Feb. 23, 2016

(54) FIREFIGHTING OR RESCUE APPARATUS INCLUDING SIDE ACCESS LADDER

(71) Applicant: HME, Incorporated, Wyoming, MI (US)

(72) Inventors: Kenneth C. Lenz, Jr., Hudsonville, MI (US); Kevin J. Longhurst, Grand Rapids, MI (US)

(73) Assignee: HME, Incorporated, Wyoming, MI (US)

( * ) Notice: Subject to any disclaimer, the term of this patent is extended or adjusted under 35 U.S.C. 154(b) by 0 days.

(21) Appl. No.: 14/669,841

(22) Filed: Mar. 26, 2015

(65) Prior Publication Data

US 2015/0273253 A1 Oct. 1, 2015

Related U.S. Application Data

(60) Provisional application No. 61/973,513, filed on Apr. 1, 2014.

(51) Int. Cl.

| | |
|---|---|
| ***A62C 27/00*** | (2006.01) |
| ***A62C 31/24*** | (2006.01) |
| *E06C 5/04* | (2006.01) |

(52) U.S. Cl.

CPC ..... *A62C 27/00* (2013.01); *A62C 31/24* (2013.01); *E06C 5/04* (2013.01)

(58) Field of Classification Search

CPC ..... E06C 5/00; E06C 5/02; E06C 5/04; E06C 5/06; A62C 27/00; A62C 31/24

See application file for complete search history.

(56) References Cited

U.S. PATENT DOCUMENTS

| | | | | | |
|---|---|---|---|---|---|
| 440,026 | A | * | 11/1890 | Gathright | 182/52 |
| 1,728,854 | A | * | 9/1929 | Carr Melvin K | 182/68.3 |
| 2,120,563 | A | * | 6/1938 | Edward Lamb | 454/338 |
| 2,841,960 | A | * | 7/1958 | Holan et al. | 91/529 |
| 2,936,848 | A | * | 5/1960 | Hall | 182/46 |
| 3,010,533 | A | * | 11/1961 | Ross | 182/2.5 |
| 3,346,052 | A | * | 10/1967 | Moore Arthur D et al. | 169/25 |
| 3,385,398 | A | * | 5/1968 | Garnett Edward V | 182/46 |
| 3,396,814 | A | * | 8/1968 | Garnett | 182/2.5 |
| 3,534,868 | A | * | 10/1970 | Eitel | 212/238 |
| 3,601,038 | A | * | 8/1971 | Hayes | 100/100 |
| 3,605,943 | A | * | 9/1971 | Beaudet et al. | 182/66.2 |
| 3,625,304 | A | * | 12/1971 | Siefermann et al. | 182/2.5 |

(Continued)

OTHER PUBLICATIONS

Firetruck image downloaded from http://hamilton-township.org/wp-content/uploads/fire_Ladder77.jpg on Mar. 5, 2015.

*Primary Examiner* — Colleen M Chavchavadze

(74) *Attorney, Agent, or Firm* — Warner Norcross & Judd LLP

(57) ABSTRACT

A firefighting or rescue apparatus includes an aerial ladder, a side stack hose bed and a side access ladder that provides access to the aerial ladder when the aerial ladder obstructs another access ladder. The side stack hose bed is mounted to a frame in a rearward portion of the apparatus. A first side access ladder is mounted to a first side of the frame forward of the side stack hose bed and optionally forward of the rear axle. Another second side access ladder is mounted to a second side of the frame. A movable side stack hose bed cover extends over the hose bed, and can include a rigid plate extending from the first side access ladder toward the aerial ladder. The first side access ladder and hose bed cover cooperatively form a path from a ground location toward the aerial ladder to facilitate access to the aerial ladder.

20 Claims, 6 Drawing Sheets

(56) References Cited

U.S. PATENT DOCUMENTS

| | | | | | |
|---|---|---|---|---|---|
| 3,675,721 | A * | 7/1972 | Davidson et al. | 169/24 |
| 4,007,793 | A * | 2/1977 | Hux et al. | 169/25 |
| 4,037,664 | A * | 7/1977 | Gibson | 169/15 |
| 4,059,170 | A * | 11/1977 | Young | 180/54.1 |
| 4,094,381 | A * | 6/1978 | Wilkerson | 182/66.1 |
| 4,431,082 | A * | 2/1984 | Bott | 182/127 |
| 4,512,412 | A * | 4/1985 | Campbell | 169/24 |
| 5,000,502 | A * | 3/1991 | Lyall | 296/186.4 |
| 5,368,317 | A * | 11/1994 | McCombs et al. | 280/4 |
| 5,634,487 | A * | 6/1997 | Downey | 137/355.12 |
| 6,006,841 | A * | 12/1999 | Hunke | 169/24 |
| 6,755,258 | B1 * | 6/2004 | Hunke et al. | 169/24 |
| 6,827,541 | B1 * | 12/2004 | Ziaylek et al. | 414/462 |
| 7,234,534 | B2 * | 6/2007 | Froland et al. | 169/24 |
| 7,784,554 | B2 * | 8/2010 | Grady et al. | 169/24 |
| 8,074,767 | B1 * | 12/2011 | Denison | 182/42 |
| 8,739,892 | B2 * | 6/2014 | Moore et al. | 169/24 |
| 2003/0102685 | A1 * | 6/2003 | Sioutis | 296/24.1 |
| 2005/0224236 | A1 * | 10/2005 | Cano | 169/24 |
| 2009/0218108 | A1 * | 9/2009 | Cano | 169/24 |
| 2010/0200328 | A1 * | 8/2010 | Savard et al. | 182/2.1 |
| 2014/0334169 | A1 * | 11/2014 | Ewert | 362/485 |

* cited by examiner

FIREFIGHTING OR RESCUE APPARATUS INCLUDING SIDE ACCESS LADDER

BACKGROUND OF THE INVENTION

The present invention relates to a firefighting apparatus, such as a fire truck, a trailer or other vehicles, and more particularly to a firefighting apparatus with an aerial ladder and one or more side access ladders.

There are a variety of fire trucks and rescue vehicles that include aerial ladders to assist in the fighting of fires. These aerial ladders usually are mounted on a frame or chassis of a fire truck. The ladder can be raised from a generally horizontal position to an angled position so that the ladder extends upwardly from the frame. The ladder can be extended and retracted to achieve varying heights for rescue operations and/or for the application of firefighting fluids.

Generally, aerial ladder trucks are used to fight fires from elevated positions or to rescue victims trapped in burning buildings. Many times, an aerial ladder truck is dispatched to an emergency location such as the location of a traffic accident, a boating accident, a plane accident, a man-made or natural disaster and/or a terrorist attack, where the ladder is to be used to rescue one or more individuals. In these circumstances, it can be helpful to quickly access and exit from the aerial ladder, and thus get on or off the ladder platform of the fire truck.

To facilitate this access and exit from the ladder platform, many aerial ladder trucks include access ladders that project from the rear end of the fire truck. These access ladders typically are the only ladders rearward of the cab (other than the aerial ladder), so when one of the access ladders is blocked by the aerial ladder extending in a direction over or near the access ladder, that access ladder is rendered unusable. In turn, the ingress and egress of users to the ladder is impaired, and use is limited to one access ladder. Where time is of the essence in a rescue operation, this access impairment can cause potentially dangerous delays.

Further, with the advent of certain side stack hose beds in some fire trucks, many new trucks come with only one rear access ladder. This can further impair access to the ladder platform and upper deck of the truck. In some cases, where the aerial ladder completely blocks the access ladder, the aerial ladder may need to be moved or rotated to provide access to the aerial ladder via the rear access ladder.

Thus, while aerial ladder trucks are currently available and helpful in a variety of situations, there remains room for improvement in their function, operation and utilization.

SUMMARY OF THE INVENTION

A firefighting or rescue apparatus is provided including an aerial ladder, an optional side stack hose bed, and a side access ladder that provides access to the aerial ladder when the aerial ladder obstructs another access ladder.

In one embodiment, the side stack hose bed is mounted to a frame of the apparatus, in a rearward portion of the apparatus. A first side access ladder is mounted to a first side of the frame forward of the side stack hose bed and optionally forward of a rear axle of the apparatus. Optionally, another second side access ladder can be mounted to a second side of the frame, opposite the first side.

In another embodiment, a movable side stack hose bed cover extends over the hose bed, and can include a rigid plate extending from the first side access ladder toward the aerial ladder. The first side access ladder and hose bed cover cooperatively can form a path from a ground location toward the aerial ladder to facilitate access to the aerial ladder.

In still another embodiment, the aerial ladder can be mounted to a turntable including an access platform adjacent the base of the aerial ladder to provide access thereto. When the aerial ladder and turntable is rotated to extend laterally from the frame near the rear, or rear corner, of the frame, at least one of the aerial ladder, the turntable and the access platform obstructs the second side access ladder. In this situation, the only structured access to the turntable, aerial ladder and access platform is provided by the first side access ladder and side stack hose bed cover.

In yet another embodiment, the side stack hose bed cover can close a top of the hose bed and can serve a dual use as a walking platform extending from the first side access ladder toward the aerial ladder.

In even another embodiment, the side stack hose bed can include a substantially horizontal floor, a first vertical sidewall and a second vertical sidewall opposite the first vertical sidewall. The side stack hose bed can include a front wall joined with the first vertical sidewall and the second vertical sidewall, and the floor to form at least a portion of a container for the fire hose. The first side access ladder can be mounted to the frame near the front wall of the hose bed.

In a further embodiment, the first side access ladder is mounted forward of the rear axle, but rearward of a front axle of the apparatus. The first access ladder can be mounted nearer to the rear axle, optionally rearward of pump discharges mounted on the frame.

The current embodiments provide a simple and effective construction that can facilitate enhanced access to an aerial ladder on a firefighting or rescue apparatus, even when the aerial ladder is being utilized in a manner that obstructs certain access ladders. Where the side stack hose bed occupies the majority of space rearward of the rear axle of a fire truck, so that no access ladders can be placed there, the present side access ladder mounted near or forward of the rear axle provides the access to the upper deck and aerial ladder of the truck. Where the hose bed includes a cover, that cover (when moved) can provide access to hose stored in the hose bed, and can operate as a walkway from the side access ladder toward the aerial ladder and/or turntable so those items can be quickly and easily accessed from the ground. These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
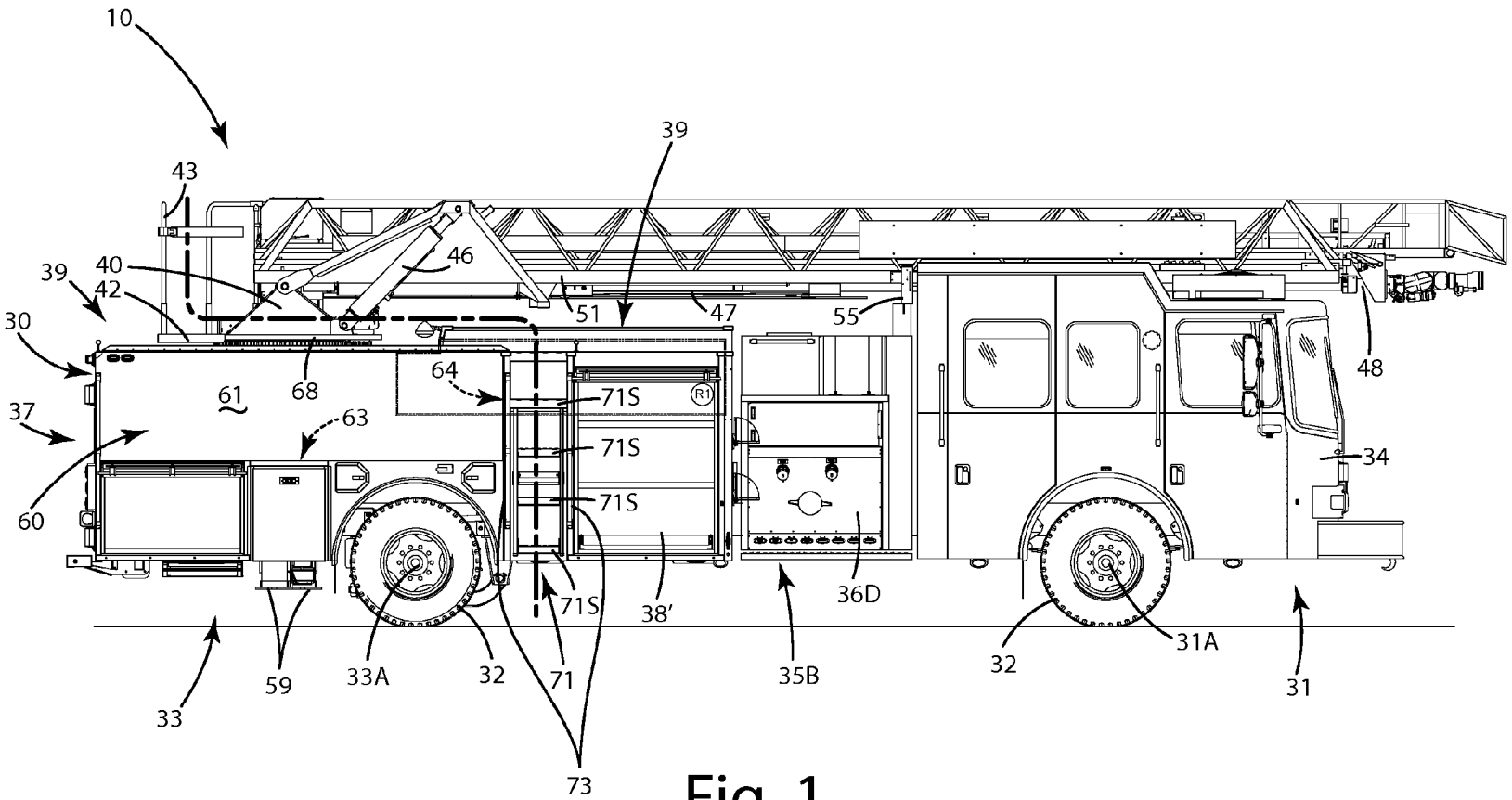
FIG. 1 is a first side view of an aerial firefighting or rescue apparatus in the form of a fire truck including a side access ladder according to a current embodiment.

A current embodiment of an aerial firefighting apparatus is illustrated in FIGS. 1-10 and generally designated 10. As shown there, the aerial firefighting apparatus is in the form of an aerial ladder fire truck. Although referred to as an aerial firefighting apparatus, as used herein, that term can also include a variety of emergency vehicles, rescue vehicles and other modes of transportation such as aerial ladder trailers or other equipment. Generally, the aerial ladder apparatus, referred to herein as a fire truck, can be a self-propelled vehicle including a ladder 50. The ladder can be mounted on a frame 30 of the fire truck via a rotatable turntable 40.

The frame 30 of the fire truck 10 can be mounted to a chassis which can be further mounted to multiple wheels 32. The wheels can be attached to conventional front and rear axles, which are further attached to the chassis of the truck. The fire truck can be mobilized via an internal combustion engine which drives the wheels via a transmission.

The fire truck 10 can include one or more internal electronic or computer controls that can operate the engine, transmission, or steering control mechanism to enable the front wheels to be steered upon transport to an emergency location. As used herein, an emergency location can be a scene of a traffic accident, a boating accident, a plane accident, a man-made or natural disaster, and/or a terrorist attack, or any other location where one or more victims' lives are endangered or otherwise compromised.

The frame 30 can include a forward portion 31 and a rearward portion 33 located at opposite ends of the fire truck 10. Optionally, although referred to as a frame, this structure can include one or more body components attached to it. Generally the rear wheels 32 and their axle are located in the rearward portion 33 of the fire truck 10. The front or steering wheels 32 can be located in the forward portion 31 of the fire truck. The frame 30 in the forward portion 31 can include a cab 34. The cab 34 can house occupants, such as firefighters or rescue personnel, as they are transported to and from an emergency location. The cab 34 can include conventional controls, such as a steering mechanism and various displays inside the cab to monitor and evaluate the operation of the vehicle 10. The cab can terminate a distance of several feet rearward of the front wheels 32, or generally forward of the pump controls and/or rearward portion 33 of the fire truck 10.

The wheels 32 can be mounted on one or more axles, for example a front axle 31A and a rear axle 33A. The front axle can be located in the forward portion 31 and the rear axle can be located in the rearward portion 33. The front axle can include a steering system to enable the front wheels to be steered. The rear axle can have one or more drive components to assist in propelling the truck 10. The rear axle can be joined with a transmission of the vehicle with a drive shaft (not shown).

On the frame, behind the cab 34, a pump control panel 36 can be mounted. Under or behind the pump control panel 36, one or more pumps (not shown) can be mounted. These pumps can be mounted to the frame. Generally, the pumps can be in fluid communication with a firefighting fluid tank (not shown) mounted to the frame in the rearward portion 33 and/or a source of firefighting fluid external to the truck, such as a fire hydrant. The pumps also can be in fluid communication with one or more hoses or waterways 47 as described below. The pumps can be configured to convey firefighting fluid from the external source or the tank to the waterways 47 in a forced manner so that the firefighting fluid can be applied to a fire.

Figure 2:
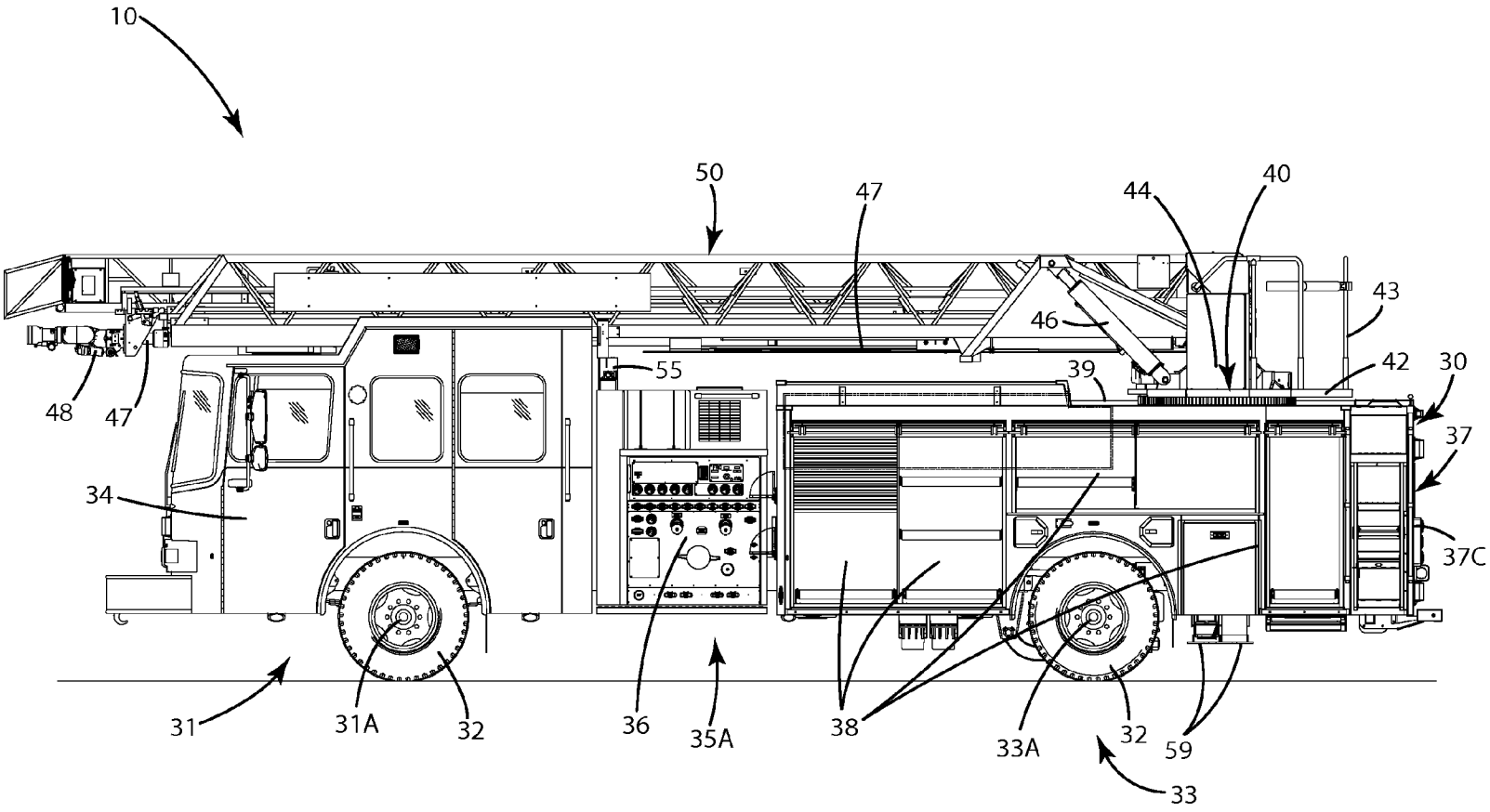
FIG. 2 is a second side view of the aerial firefighting apparatus including another side access ladder.

The frame 30 can include first compartments or lockers 38 mounted rearward of the pump control panel 36, generally in the rearward portion 33 of the fire truck 10 on the first side or driver's side 35A as shown in FIG. 2. These compartments optionally can be located on and accessible from the first side 35A of the fire truck, and can be sized and configured to store supplies and equipment useful for easy access at an emergency location. Multiple lockers or compartments can fill a substantial portion of the side 35A in the rearward portion 33. As illustrated, some lockers 38 can be mounted forward of the rear axle 33A, some over the rear axle, and some rearward of the rear axle. Generally, all the compartments on side 35A can be located forward of the second side access ladder 72. Further optionally, the compartments 38 can be rearward of the front axle and rearward of the pump control panel 36.

The frame 30 also can include second compartments or lockers 38' mounted rearward of the pump discharge 36D, generally in the rearward portion 33 of the fire truck 10 on the second side or passenger side 35B as shown in FIG. 1. These compartments optionally can be located on and accessible from the second side 35B of the fire truck, and can be sized and configured to store supplies and equipment useful for easy access at an emergency location. Optionally, the second compartments or lockers 38' can be located substantially only forward of the rear axle 33A, and forward of the side stack hose bed 60, as well as forward of the first side access ladder 71. Further optionally, the second compartments 38' can be rearward of the front axle, rearward of the pump discharge 36D and rearward of the cab 34.

Figure 3:
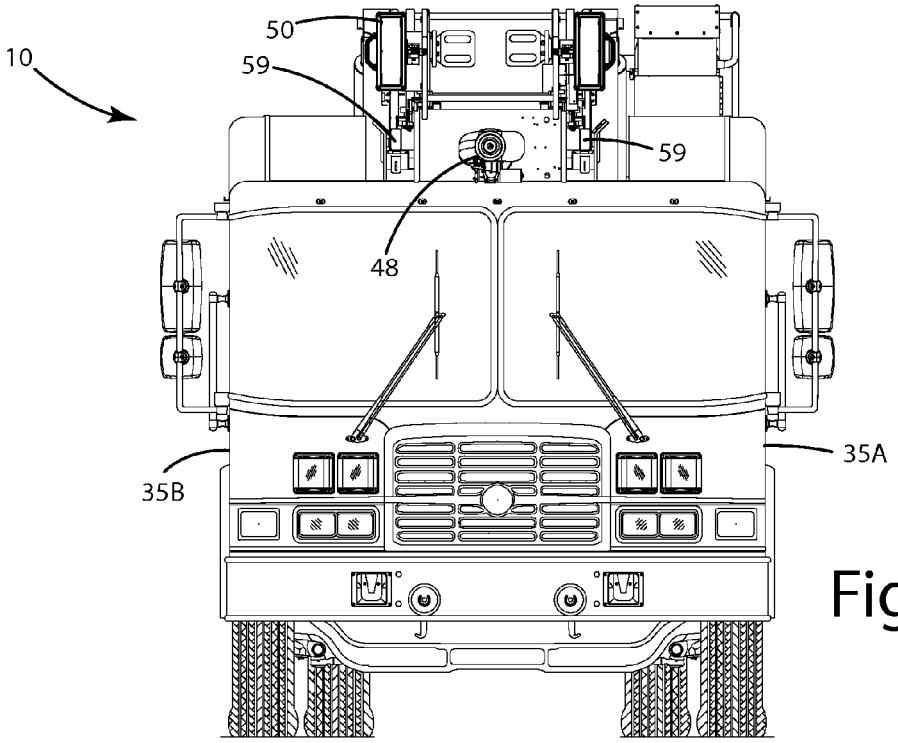
FIG. 3 is a front view of the aerial firefighting apparatus.
Figure 4:
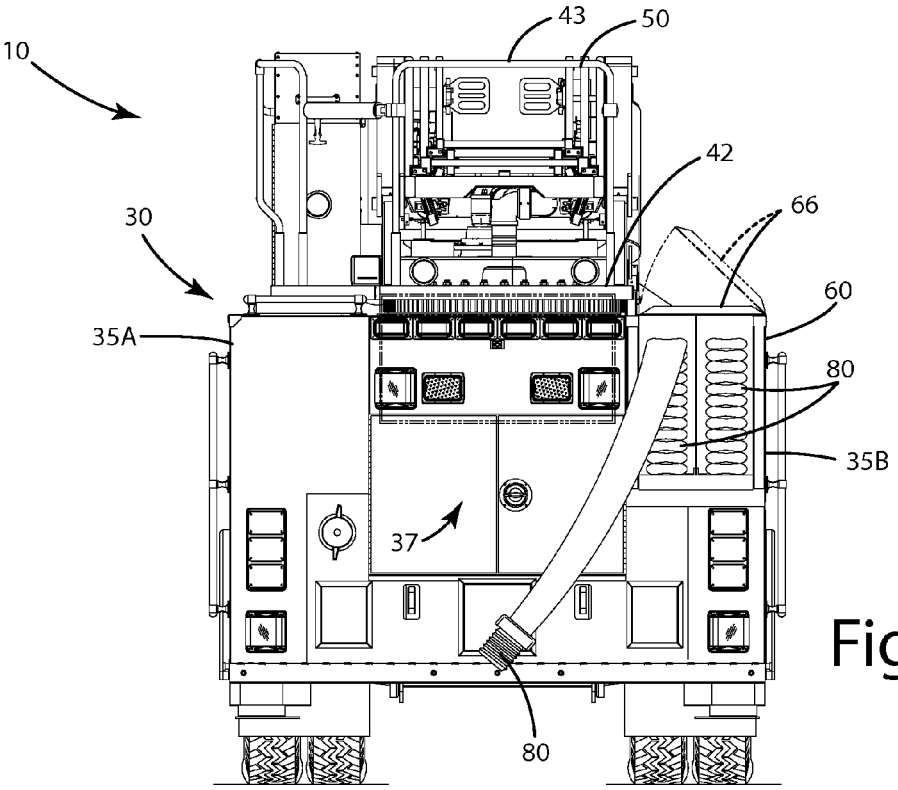
FIG. 4 is a rear view of the aerial firefighting apparatus.
Figure 5:
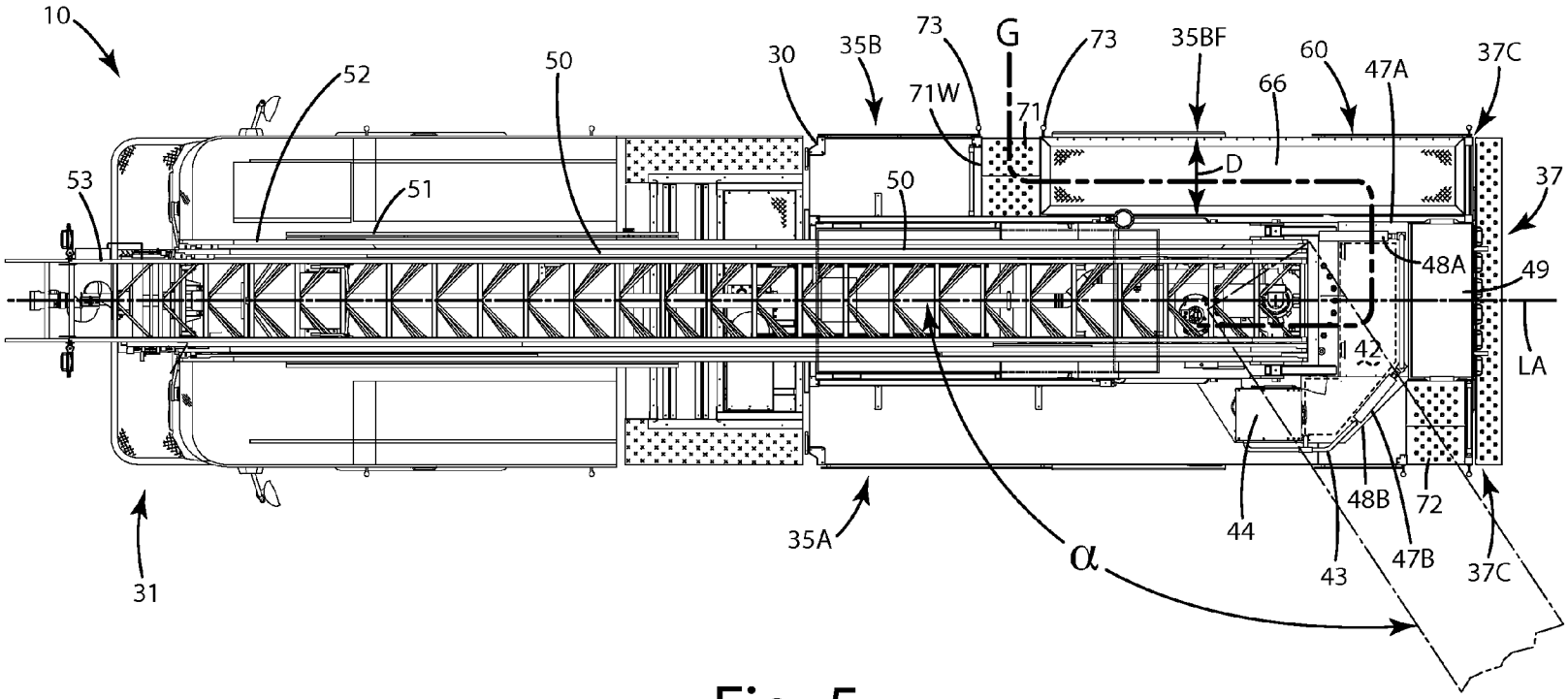
FIG. 5 is a top view of the aerial firefighting apparatus, with the aerial ladder shown in a stored mode and in a use mode in broken lines.

As shown in FIGS. 1, 3 and 4, the fire truck and frame 30 can include an upper deck 39 on which the aerial ladder 50 is mounted. The aerial ladder 50 can be mounted directly to the turntable 40, which is rotatably mounted to the upper deck and/or frame. The turntable can be configured to pivot or rotate the ladder 50 and its sections to a predetermined angle $\alpha$ relative to the longitudinal axis LA of the truck 10, as shown in FIG. 5. Generally, the turntable 40 enables the aerial ladder 50, when raised from a generally horizontal stored position, to pivot through a variety of different orientations relative to the longitudinal axis LA of the truck. The turntable 40 can include its own controls accessible from the rear of the truck and/or within the cab. The controls can enable an operator to control the rotation or pivoting of the turntable 40 throughout a range of angles relative to the longitudinal axis LA, and optionally the extension and retraction of the aerial ladder 50, the raising and lowering of the ladder 50, as well as the selective illumination of various lighting elements 59 associated with the ladder.

The turntable 40 can include an access platform 42 attached thereto. The access platform 42 can extend rearwardly from the aerial ladder 50 a preselected distance sufficient to enable a user to attain a firm footing thereon before engaging or disengaging the ladder 50. This platform optionally can be in the form of a plate connected to the turntable. The plate can be rigid enough and/or supported by underlying structure to support the weight of multiple users on the platform.

The access platform 42 can extend laterally away from the longitudinal axis LA and can provide access to a control 44 of the turntable and/or ladder as desired. The access platform 42 can be configured to include one or more primary safety rails 43 that extend upwardly from the access platform 42 a preselected distance. These rails can prevent accidental departure from the access platform and/or turntable during operation or use thereof. Generally, the primary guide rails 43 can be of a rigid construction made, for example from a tubular steel member. The primary guide rails 43 can be outfitted with one or more secondary guide rails 48A and 48B. These secondary guide rails can be movably coupled to the primary guide rail 43. Generally, they can be in the form of a strap, web, chord, rope, cable, bar, tube or other structure that can be readily rolled, moved, pivoted or otherwise removed to gain access to the access platform 42. Although shown as being a relatively large access platform, the size of the platform can be reduced depending on the particular application and the size of the aerial ladder and/or truck on which it is used.

As shown in FIG. 5, the access platform 42 can include a first entry portion 47A and a second entry portion 47B. The first entry portion 47A can provide access from the access platform 42 to the cover 66 of the side stack hose bed 60. The second entry portion 47B can provide access to the access platform 42 via the second side access ladder 72.

Optionally, the entry portions 47A and 47B can be selectively obstructed by the secondary guide rails 48A and 48B, respectively. The precise obstruction location can depend on the location and orientation of the aerial ladder 50 relative to the respective side access ladders, as further described below. For example, when the aerial ladder 50 is in the position generally shown in FIG. 5, access can be gained to the access platform 42 and generally the aerial ladder 50 via the first side access ladder 71 as well as the second side access ladder 72. Accordingly, in this situation, one or both of the secondary guide rails 48A, 48B can be moved out of the way to provide such access. Where the aerial ladder 50 is raised and/or otherwise positioned in the configuration shown in broken lines in FIG. 5, the ladder obstructs the second side access ladder 72. Thus, the only access can be via the cover 66 and the first side access ladder 71. In this case, the secondary guide rail 48A is removed to allow access to the access platform 42 from the cover 66 and the first side access ladder 71 as further explained below. Optionally, although not shown, additional guide rails can be added to the first vertical sidewall 61 and can extend upwardly along one side of the side stack hose bed cover 66.

As mentioned above, the frame 30 can include a first side 35A and a second side 35B located opposite one another. Generally, the turntable 40 can rotate the ladder 50, optionally when it is out of its generally horizontal stored position, outward beyond one of the sides 35A or 35B and at an angle transverse to the longitudinal axis LA.

The ladder 50 can include multiple ladder sections that can be extended and retracted, and/or raised and lowered. As shown in FIGS. 1, 2 and 5, the ladder 50 can include a base or boom section 51, a first upper ladder section 52 and a second upper ladder section 53. Of course, although three ladder sections are illustrated, any number of ladders or sections can be utilized. Further, the arrangement and connection of the various ladder portions to one another can be varied depending on the application.

The ladder sections 51, 52 and 53 can be movably joined with one another so that the entire ladder 50 can be extended and retracted by moving the ladder sections 51, 52 and 53 with respect to one another. As an example, the ladder base section 51 is movably joined with the second ladder section 52 which is itself movably joined with the second upper ladder portion 53. Optionally, the ladder sections can be coupled to one another so that as the ladder generally extends, each of the ladder sections 52 and 53 move relative to one another and optionally relative to the base section 51.

Further optionally, the base section 51, also referred to as base or boom, can be fixedly and pivotally mounted to the turntable 40. The base section 51 can pivot up and down about an axis that is generally horizontal. The aerial ladder can be raised and lowered under the power of a ladder raising and lowering mechanism 46. This mechanism 46 can be mounted between the turntable 40 and the aerial ladder 50, optionally directly mounted to the base 51. The mechanism 46 can be in the form of one or more hydraulic rams in fluid communication with a source of pressurized fluid that is operable to raise and lower the ladder 50 from the generally horizontal stored position to a raised position. The ladder can be extended, and in particular the sections 52 and 53 can be extended relative to the base 51, via utilization of other hydraulic rams (not shown) that operatively connect a pair of the ladder sections.

The turntable 40 also can be in communication with the source of pressurized fluid so that the turntable and aerial ladder can be rotated under hydraulic force to extend out one or more sides 35A, 35B of the truck 10. Of course, other non-hydraulic mechanisms can be used to move the ladder and its components, such as electric motors, pneumatic mechanisms, or others depending on the application. Generally, the ladder raising and lowering mechanism 46 and the turntable 40 can be cooperatively operated to lift and rotate the ladder 50 out of a generally horizontal stored position to a variety of other operative positions and angles, and vice-versa.

As shown in FIGS. 1 and 2, the base 51 of the ladder can include a box or channel shaped cross-section. With this construction, the base 51 can be substantially reinforced and rigid. Optionally, the base 51 can be constructed from steel and/or other extremely rigid alloys or metal, and further optionally, not constructed from aluminum or other soft metals. The base 51 further can be reinforced with a variety of reinforcing lattice or other structure. Further optionally, the base 51 can include a second boom or fly boom telescopingly mounted relative thereto. The second boom generally can extend and retract from the base boom. Various ladder sections can be mounted to the secondary boom in a fixed manner, utilizing optional mounting brackets.

The ladder, base boom and secondary boom can include one or more waterways 47 mounted thereto. These waterways are operable to transfer a continuous supply of firefighting fluid to the water outlet 48 which is generally in the form of a nozzle. Generally, the waterway receives pressurized firefighting fluid from a pump or storage tank on the frame 30. More particularly, the nozzle 48 assists in pressurizing and/or shaping the continuous stream of firefighting fluid from the waterway 47 toward a fire in a burning building, in a vehicle or elsewhere. Generally, the waterway can include multiple rigid, tubular sections that telescope and slide relative to one another. Optionally, the waterways can become progressively smaller, closer to the water outlet 48.

The waterways 47 can be disposed along and extend the length of the ladder 50. The waterways are maintained in close proximity to (and usually under) the ladder sections 52 and 53, even as the ladder 50 is moved between extended and retracted positions. The telescoping tubular sections of the waterways can cooperate with one another to provide a continuous fluid passageway along the length of the ladder 50.

As illustrated in FIGS. 1 and 2, the fire truck or frame can include a ladder support 55. When the ladder 50 is in a generally horizontal stored position, the base 51 rests upon the ladder support 55, and optionally a plate or pad mounted atop the support 55. This plate or pad can be of a cushioned material, such as rubber, to absorb vibration and minimize impact between the base 51 and the support 55.

Optionally, the ladder support 55 is mounted directly to the frame 30 in a rigid supportive manner. This is so that the immense weight of the ladder 50 can be supported without resting on other structural components of the vehicle, such as the cab 34 or the forward portion 31 of the truck in general. The ladder support 55 supports the ladder 50 and in particular the base 51, so that it is elevated a preselected distance above the cab 34 when the ladder is in the generally horizontal stored position.

As shown in FIGS. 1 and 2, the fire truck 10 optionally can be outfitted with one or more stabilizer legs 59 that can be operated to extend outwardly from the rearward portion and/or forward portion of the truck to stabilize the truck and prevent it from tipping when the ladder 50 is extended outward at some predetermined angle $\alpha$ relative to the longitudinal axis LA of the truck.

Figure 6:
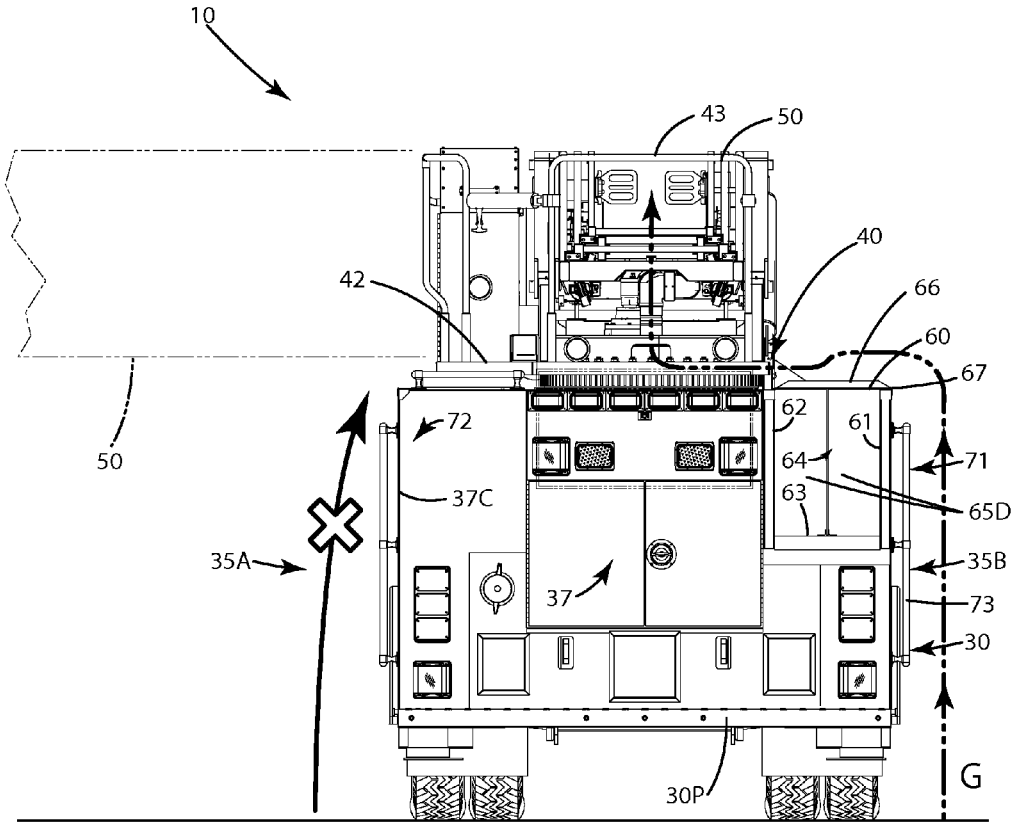
FIG. 6 is a rear view of the firefighting apparatus illustrating the aerial ladder in a use mode in broken lines where a side access ladder is used to gain access to the aerial ladder.

As illustrated in FIGS. 1, 4 and 6, the frame can include a side stack hose bed 60. The side stack hose bed can be mounted to the frame 30, optionally in a location laterally displaced toward one of the sides 35A or 35B relative to the longitudinal axis LA of the fire truck as shown in FIG. 5. The side stack hose bed 60 can extend from an outer side face 35BF a distance D (FIG. 5) from the ladder 50. The preselected distance D can be sufficient to store a desired amount of flexible fire hose. Generally, the side stack hose bed is configured to form a container in which the hose can be temporarily stored. The hose can be folded upon itself multiple times with the greater lengths of the hose running from the rear 37 of the truck toward the forward portion 31 of the truck.

As shown in FIG. 1, the side stack hose bed can be located substantially only in the rearward portion 33 of the truck 10. The hose bed 60 can extend from the rear 37 to a location over the rear axle 33A and up to the first side access ladder 71. In some cases, this hose bed can extend beyond that location and more toward the pump discharge 36D and/or front axle 31A. Of course, with a hose bed being extended accordingly, the space for the lockers 38' can be consumed. Moreover, the first access ladder 71 can be placed a farther distance from the turntable 40 and aerial ladder 50.

Although shown with a single rear axle 33A, the apparatus or truck described herein can include multiple rear axles. In such a construction, the side stack hose bed can extend over multiple rear axles. Further, the turntable can be located generally above and rearward of the forwardmost version of the rear axle.

The side stack hose bed 60 generally includes a floor 63. The floor 63 can be disposed above the rear wheel 32 and can be generally horizontal when the vehicle is on level ground. The floor 63 can extend rearward from the rear 37 of the truck 10 forwardly to the front wall 64. The floor 63 can be reinforced with ribbing or other structural components to assist in ensuring its structural rigidity and ability to support a significant weight of fire hose resting on the floor.

As shown in FIG. 1, the front wall 64 generally forms the forward most portion of the side stack hose bed 60. The front wall can be located above the rear wheel 32 and/or axle 33A or slightly ahead of these items. Optionally, the front wall 64 also can form part of a recessed well 71W (FIG. 5) within which the first side access ladder 71 is disposed. In this construction, the front wall 64 can serve a dual function as the front wall of the side stack hose bed as well as a structural wall or component for the side access ladder 71.

The side stack hose bed 60 can also include one or more rear doors 65D as shown in FIG. 6. Those rear doors can pivot about hinges disposed in a vertical plane so that access can be gained to the interior of the side stack hose bed 60. The doors of course can be deleted from the truck 10 in certain applications.

The side stack hose bed 60 also can include a first vertical sidewall 61 and a second vertical side wall 62 that are each disposed on opposite sides of the side stack hose bed. Generally, the first vertical side wall and second vertical side wall run parallel to the longitudinal axis LA of the truck 10. These vertical sidewalls also extend upwardly in a substantially vertical orientation relative to the ground alongside the frame 30. The first and second sidewalls can be joined with the floor 63 of the hose bed 60 using conventional fasteners. The first and second sidewalls also can extend upwardly in the rearward portion 33 of the truck 10 a preselected distance sufficient to provide a desired container size so that the flexible hose can be stored in the side stack hose bed. The first and second sidewalls can be distanced from one another optionally about 1 foot to about 6 feet, 2 feet to about 4 feet and optionally about 4 feet. This can provide ample space to stack multiple rows of fire hose folded upon itself within the side stack hose bed.

As shown in FIG. 1, the substantially vertical sidewalls 61 and 62 also extend longitudinally from the rear 37 of the truck forward to the side access ladder 71. Generally, the sidewalls can extend upwardly from above the rear axle 33A a preselected distance. This distance can be optionally about 1 foot to about 6 feet, about 2 feet to about 4 feet and optionally about 4 feet, depending on the particular application.

Generally, the first and second vertical sidewalls, the floor and the front wall form a container that is sized and adapted to store the flexible fire hose folded over and upon itself multiple times in a stored mode. The flexible fire hose is provided on the fire truck so that it can be used in a deployed mode in which the firefighting fluid is conveyed therethrough. To achieve this deployed mode, the rear doors 65D and/or the cover 66 of the side hose bed 60 can be opened to gain access to the hose. This is better illustrated in FIG. 4. There, the hose 80 can be pulled out from the rear of the side stack hose bed 60 with the doors 65D being generally swung open to provide the access. After use, the hose can be reloaded into the side stack hose bed 60 in a reverse process. To facilitate reloading, the doors and/or cover can be opened to provide access and enable a user to neatly and cleanly stack the hose upon itself folding it over multiple times in the side stack hose bed.

As shown in FIGS. 5 and 6, the side stack hose bed 60 includes a side stack hose bed cover 66. This cover generally includes a substantially horizontal (when the vehicle is on level ground) rigid, elongated plate. The elongated plate can be outfitted with a diamond plate or a tread pattern to provide enhanced traction when a user traverses the cover 66. The cover 66 can be reinforced with an underlying lattice, frame or other structure to provide enhanced rigidity and prevent buckling under excessive loads. The side stack hose bed cover 66 is illustrated as a single cover extending from the front wall to the rear doors of the side stack bed generally above and perpendicular to the first and second sidewalls 61 and 62. If desired, this hose bed cover can be segmented into multiple covers disposed in series extending from the side access ladder 71 to the rear 37 of the truck 10, or other configurations.

The side stack hose bed cover 66 can be movably joined with the first or second vertical sidewall. As illustrated in FIG. 6, the cover is mounted to the first sidewall with a hinge 67. Of course, the hinge 67 can alternatively be placed on the second vertical sidewall 62. Indeed in some constructions, the cover can include hinges on both sidewalls and can be split down the center lengthwise, so it includes two opposing doors that open upward away from the floor 63 of the side stack hose bed 60. As illustrated in FIG. 6, the hinge 67 can generally run the length of the first vertical sidewall from the rear 37 to the well 71W of the side access ladder 71.

With reference to FIGS. 5 and 6, the cover 66 can be configured to provide ingress and egress to and from the ladder 50 generally from the platform 42 to the side access ladder 71. More particularly, a user can take a path G to and from the ground by traversing up the side access ladder 71 across the cover 66 and to the access ladder platform 42 and/or turntable 40 to access the ladder 50. In general, the side stack hose bed cover can be configured to enable a user to traverse from the side access ladder to the access platform, generally over the side stack hose bed cover 66. Further, the side access ladder provides access to the side stack hose bed cover 66 to enable a user to further access the access platform 42 and/or the ladder 50.

The first side access ladder 71 can provide a path from a ground location toward the side stack hose bed cover. The hose bed cover 66 then provides the further path to the access platform 42, and in particular, one or more of the entry portions 47A and 47B, depending on the orientation and angle of rotation of the ladder 50. Optionally, when the ladder 50 is disposed generally perpendicular to the longitudinal axis, the access platform 42 extends outwardly over the cover 66. The entry portion 47A is aligned generally parallel to the length of the cover 66. In this manner, users can quickly walk on and off the access platform 42 via the cover 66. From there, the side access ladder 71 provides vertical access to and from the ground adjacent the truck 10.

As shown in FIGS. 1, 5 and 6, the first side access ladder 71 can extend from the bottom of the truck upward to the upper deck 39 of the truck. The side access ladder can include multiple steps 71S. These steps can be spaced sufficiently to enable a variety of different sized users to traverse up and down the side access ladder. The steps also can be configured as rungs placed in parallel one above the other on rails or on a step frame secured to the frame 30. The step frame optionally can enable the steps 71S to vertically overlap one another, similar to a staircase, rather than a runged ladder. Further, the step frame and steps 71S optionally can fold or move outward from the longitudinal axis LA of the truck so increase the footprint of the ladder, and thus make the ladder seem more like a staircase. This staircase construction can be facilitated by having a relatively deep well 71W within which the ladder is positioned. Further optionally, all the steps 71S are collectively joined with one another and supported by the step frame, rather than being individually bolted or fastened to the frame 30 of the truck 10.

The first access ladder can also include grab bars 73 disposed adjacent the ladder, on first and second sides of the side access ladder 71. Where the ladder is configured more like a staircase, sometimes a user will not utilize the grab bars.

As mentioned above, the first side access ladder 71 is disposed generally forward of the rear axle 33A and generally forward of the side stack hose bed 60. Optionally, it also can be disposed rearward of the lockers 38' and the pump discharge 36D. It also can be located rearward of the cab 34 and the front axle 31A. Generally, the side access ladder 71 is not disposed in the forward portion 31 of the truck. Further optionally, the forward portion of the truck can be void of any types of ladders extending upwardly to provide access to the upper deck, cover access platform and/or turntable 40 or ladder in general. The safety bars 73 can extend outwardly from the side 35B of the truck. The bars can be in the form of generally vertical tubes or handles that extend upward along the side of the frame 30. Of course, in some cases, the safety bars can be deleted and be absent from the truck.

As illustrated in FIG. 6, the rear 37 of the truck optionally can be substantially void of any ladders that extend from the rear platform 30P of the frame. In turn, the rear 37 of the truck has no dedicated structure to climb up to the upper deck and/or otherwise access the turntable or ladder.

Optionally, the truck 10 can also include at least one additional second side access ladder 72. This ladder can be generally identical to the first side access ladder and can include the same features. However, the second side access ladder is mounted in the rearward portion 33 of the vehicle as shown in FIG. 2, rearward of the lockers, pump controls and other apparatus on the side 35A of the truck. Further, the second side access ladder 72 generally can be disposed and located rearward of the rear axle 33A and/or rear wheel 32. This can provide a slightly varied location for entrance for ingress and egress to the turntable and/or access platform 42. Generally, the ladder is mounted immediately adjacent the rear corner 37C of the truck without extending onto the rear 37 of the truck. Of course in some implementations, it can be tilted at an angle 45° relative to the longitudinal axis LA to provide varied access to the platform from the rear corner and/or rear of the truck.

The orientation of the first and second side access ladders results in the ladders 71, 72 being non-symmetrically disposed about the longitudinal axis LA.

Operation of the aerial firefighting or rescue apparatus of the current embodiments will now be described. The firefighting apparatus 10, optionally in the form of an aerial fire truck, can be used to fight fires in a building or other structure and/or to assist in rescue operations. In rescue operations, the ladder can be elevated to an angle relative to horizontal and extended to an elevated position where victims are trapped. The victims can step onto the aerial ladder and traverse down the ladder, to the turntable, and off the truck via one of the side access ladders 71, 72 to a safe location on the ground.

In some rescue operations, the aerial ladder can be disposed generally horizontally, but turned with the turntable so that the aerial ladder projects laterally from one of the sides 35A, 35B of the truck, the rear 37 of the truck, and/or one of the rear corners 37C of the truck. In such a configuration, the aerial ladder can be used to provide a "bridge" to a structure or location where one or more victims are trapped. In a particular example, the aerial ladder 50 can be extended laterally from a side 35A of the truck 10 as shown in FIG. 6. The truck can be located near a body of water (not shown) with the ladder, extending out over the water. The ladder can be used to provide access to a stranded boater or motorist, an individual trapped in a floodwater, or some other victim. In this manner, the ladder 50 can provide a bridge for individuals to traverse from one area onto the truck 10.

In general, the fire truck 10 can be driven to an emergency location. While in transport, the aerial ladder can be in the horizontal stored position as shown in FIGS. 1-4. At the emergency location, where the ladder is to be used for a rescue or firefighting operation, the ladder can be horizontally lifted using the raising and lowering mechanism 46. The ladder also can be pivoted or rotated with the turntable 40 so that it is at an angle relative to the longitudinal axis LA of the vehicle as shown in FIGS. 5 and 6, or otherwise extends beyond the sides and/or rear of the truck 10.

Figure 7:
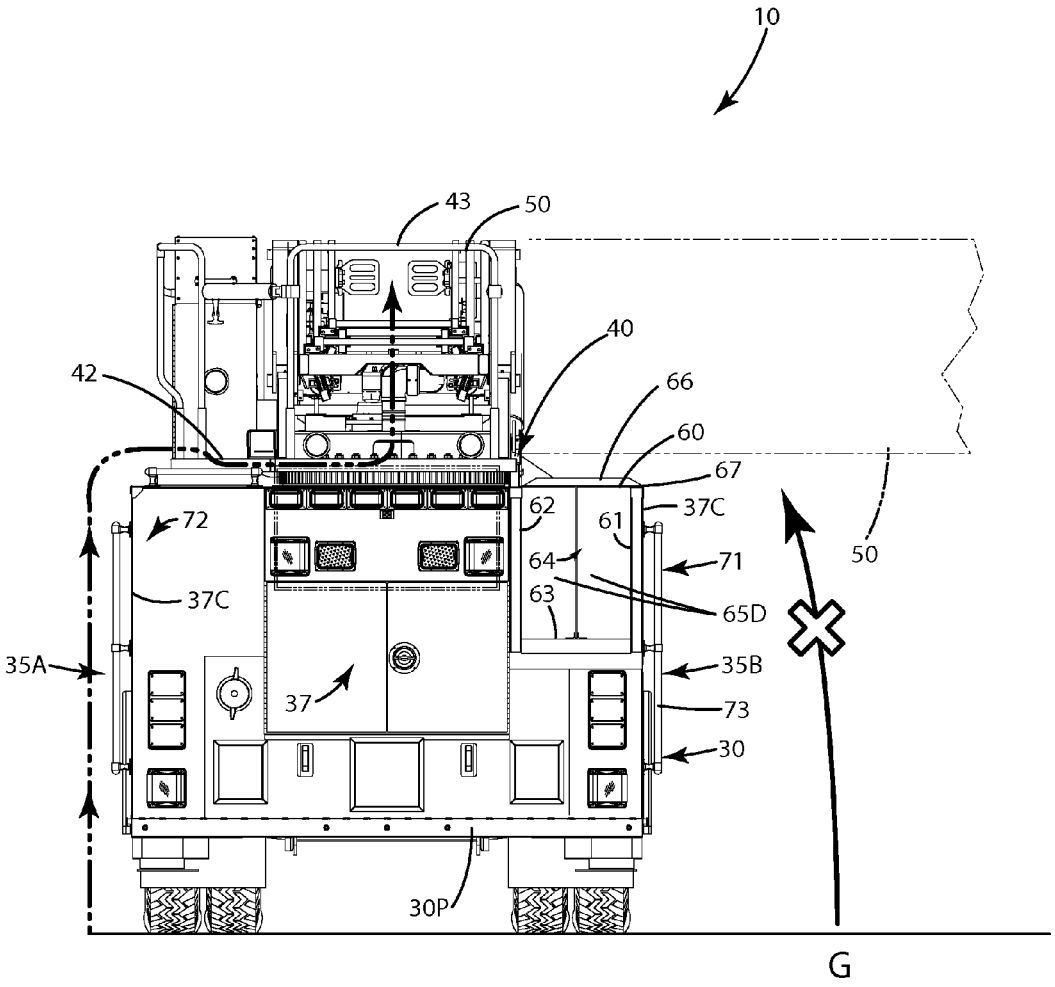
FIG. 7 is another rear view of the firefighting apparatus illustrating the aerial ladder in a use mode in broken lines where another, rear side access ladder is utilized to gain access to the aerial ladder.

As shown in FIGS. 5, 6 and 7, the side access ladders 71/72 can provide varied or alternate access to the access platform 42, the turntable 40 and/or the ladder 50. As shown in FIG. 5, the ladder can be rotated to extend laterally outward from the side 35A, over the rear corner 37C and/or over the rear 37 of the truck 10. In this case, the ladder obstructs the pathway of a user to traverse up the second access ladder 72 as indicated by the X in FIG. 5. Accordingly, a user cannot access the access platform 42 via the second access ladder 72. This is also illustrated in FIG. 6 where a user cannot utilize the pathway up the second side access ladder 72 to access the platform because it is obstructed by the ladder 50.

In such a situation, a user can go to the opposite side 35B of the truck 10 and access the first side access ladder 71. The user can traverse upward, vertically along the access ladder 71 and step onto the side stack hose bed cover 66. From there, the user can traverse the side stack hose bed cover a preselected distance, which is dependent upon the overlap of the platform 42 over the cover of 66, until the user reaches the entry portion 47A of the access platform 42. The user can remove the secondary guide rail 48A and enter the access platform 42. From there, the user can access the ladder. A user also can utilize an opposite pathway to depart from the ladder and traverse across the cover to the first side access ladder to a ground location.

In some cases, the first side access ladder 71 can be alternatively obstructed. For example, when the aerial ladder 50 is rotated as shown in FIG. 7 to extend outwardly over the first side access ladder 71, the aerial ladder obstructs the side access ladder 71 as indicated by the X. Accordingly, a user can transverse to the opposite side 35A of the truck and climb the second access ladder 72. From there, the user can climb onto the access platform 42 and thereby gain access to the ladder 50 and its components. The user can also reverse this pathway to exit the aerial ladder and/or platform to the second access ladder 72 and ultimately to a ground location.

After the ladder 50 is no longer needed at the emergency location, the ladder can then be moved from its raised position to the generally horizontal stored position as shown in FIGS. 1, 4 and 5. The firefighting apparatus then can be transported back to its garage or station.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An aerial firefighting apparatus comprising:

a frame including a plurality of wheels configured to enable transportation of the apparatus to an emergency location, the frame including a forward portion having a cab for housing at least one occupant of the apparatus, a rearward portion including a rear wall located rearward of the cab, a first side and a second side opposite the first side, the frame including at least one rear axle mounted to the frame in the rearward portion;

an aerial ladder that is both extendible and retractable, the aerial ladder comprising a base and at least one upper ladder section movably joined with the base so that the upper ladder section can be extended and retracted relative to the base to provide extension and retraction of the aerial ladder, the aerial ladder being movably mounted relative to the frame so that the aerial ladder can be raised from a generally horizontal stored position to a raised position wherein the aerial ladder extends upwardly at an angle from the frame;

an aerial ladder raising and lowering mechanism, connected to the aerial ladder, being configured to move the aerial ladder between the generally horizontal stored position and the raised position;

a turntable to which the aerial ladder is mounted, the turntable being selectively rotatable so that the base can be swung to a position where the aerial ladder extends beyond at least one of the first side, the second side and the rearward portion of the apparatus, the turntable located generally rearward of the rear axle of the apparatus, the turntable including an access platform rotatable with the turntable;

a waterway comprising a water outlet, the waterway joined with the aerial ladder, the water outlet adapted to shoot pressurized firefighting fluid provided from a fire fighting fluid source;

a side stack hose bed mounted to the frame in the rearward portion, the side stack hose bed including a floor, a first vertical sidewall and a second vertical sidewall opposite the first vertical sidewall, the side stack hose bed including a front wall joined with the first vertical sidewall and the second vertical sidewall with the floor, the first vertical sidewall, the second vertical sidewall, and the front wall forming a container storing a flexible fire hose folded over upon itself a plurality of times in a stored mode, the flexible fire hose being selectively operable in a deployed mode in which firefighting fluid is conveyed therethrough;

a first side access ladder mounted to the first side of the frame forward of the front wall of the side stack hose bed, and forward of the rear axle, the first side access ladder including a plurality of steps; and a side stack hose bed cover including a generally horizontal, rigid elongated plate, the side stack hose bed cover being hingedly joined with the side stack hose bed to form a portion of the container, the side stack hose bed cover being moveable to access the container from a top of the side stack hose bed, the side stack hose bed cover extending generally from the first side access ladder toward the access platform, the side stack hose bed having an opening in a rear of the side stack hose bed, opposite the front wall and substantially parallel to the rear wall of the frame, such that the flexible fire hose stored within the container is deployable through the opening to a rear of the frame, wherein the first side access ladder provides a path from a ground location toward the side stack hose bed cover, wherein the side stack hose bed cover is configured to enable a user to traverse from the side access ladder to the access platform over the side stack hose bed cover.

2. The aerial firefighting apparatus of claim 1 comprising at least one generally vertical, elongated grab bar disposed adjacent the first side access ladder.

3. The aerial firefighting apparatus of claim 1 comprising a second side access ladder mounted on the second side of the frame, opposite the first side, wherein the second side access ladder is mounted rearward of the rear axle, adjacent a rear corner of the frame, the second side access ladder including at least three steps vertically mounted one over the other.

4. The aerial firefighting apparatus of claim 3 comprising at least one locker mounted to the frame forward of the second side access ladder on the second side.

5. The aerial firefighting apparatus of claim 4 wherein at least one of the aerial ladder, the turntable and the access platform obstructs the second side access ladder when the aerial ladder is rotated to extend laterally from the frame near the rear corner of the frame.

6. The aerial firefighting apparatus of claim 5 wherein the only structured access from the ground location to the turntable and the access platform is provided by the first side access ladder and side stack hose bed cover on the first side of the frame when the aerial ladder is rotated to extend laterally from the frame near the rear corner.

7. The aerial firefighting apparatus of claim 4 comprising another locker mounted to the frame forward of the first side access ladder on the first side.

8. The aerial firefighting apparatus of claim 1 wherein the frame includes at least one front axle mounted to the frame in the forward portion, wherein the first side access ladder is mounted between the front axle and the rear axle, but closer to the rear axle.

9. An aerial firefighting apparatus comprising:

a frame configured to enable transportation of the apparatus to an emergency location, the frame including a forward portion, a rearward portion, a rear, a first side and a second side opposite the first side, and a rear axle mounted to the frame in the rearward portion;

an aerial ladder that is both extendible and retractable, the aerial ladder comprising a base and at least one upper ladder section movably joined with the base so that the upper ladder section can be extended and retracted relative to the base to provide extension and retraction of the aerial ladder, the aerial ladder being movably mounted relative to the frame so that the aerial ladder can be raised from a generally horizontal stored position to a raised position wherein the aerial ladder extends upwardly at an angle from the frame, the aerial ladder including a waterway extending along the base and the at least one upper ladder section;

a turntable to which the aerial ladder is mounted, the turntable being selectively rotatable so that the base can be swung to a position where the aerial ladder extends beyond at least one of the first side, the second side and the rear of the frame, the turntable including an access platform that rotates with the aerial ladder;

a side stack hose bed mounted to the frame in the rearward portion, the side stack hose bed forming a container adapted to store a flexible fire hose folded over upon itself a plurality of times in a stored mode, the flexible fire hose being selectively operable in a deployed mode in which firefighting fluid is conveyed therethrough;

a first side access ladder mounted to the first side of the frame forward of the side stack hose bed, within a recessed well formed at least in part by a front wall of the side stack hose bed, and forward of the rear axle, the first side access ladder including a plurality of steps; and a side stack hose bed cover extending over the container to form a portion of the container, the side stack hose bed cover being moveable to access the container from a top of the side stack hose bed, the side stack hose bed cover extending generally from the first side access ladder toward the aerial ladder, wherein the first side access ladder provides a path from a ground location up to the side stack hose bed cover so that a user can step from a top step of the plurality of steps onto the side stack hose bed cover, wherein the side stack hose bed cover is configured to enable a user to traverse from the side access ladder to the aerial ladder over the side stack hose bed cover.

10. The aerial firefighting apparatus of claim 9 wherein the side stack hose bed cover is hingedly mounted to the side stack hose bed so that the side stack hose bed cover can be pivoted between a walkway mode, where the side stack hose bed cover provides a walkway from the first side access ladder to the aerial ladder, and an access mode, wherein the side stack hose bed cover provides access to an interior of the container.

11. The aerial firefighting apparatus of claim 10 wherein the plurality of steps includes at least three steps.

12. The aerial firefighting apparatus of claim 11 comprising a second side access ladder mounted on the second side of the frame, opposite the first side, wherein the second side access ladder is mounted rearward of the rear axle, adjacent a rear corner of the frame, wherein the rear of the frame is void of any access ladder.

13. The aerial firefighting apparatus of claim 12 wherein at least one of the aerial ladder and the turntable obstructs the second side access ladder when the aerial ladder is rotated to extend laterally from the frame near the rear corner.

14. The aerial firefighting apparatus of claim 13 wherein the only structured access from the ground location to the turntable and the access platform is provided by the first side access ladder and side stack hose bed cover on the first side of the frame when the aerial ladder is rotated to extend laterally from the frame near the rear corner.

15. The aerial firefighting apparatus of claim 9 wherein the side stack hose bed includes a substantially horizontal floor, a first vertical sidewall and a second vertical sidewall opposite the first vertical sidewall, the side stack hose bed including a front wall joined with the first vertical sidewall and the second vertical sidewall, the floor, the first vertical sidewall, the second vertical sidewall, and the front wall forming the container, wherein the first side access ladder is mounted to the frame adjacent the front wall, with a portion of the front wall forming a part of a step well of the first side access ladder.

16. An aerial firefighting apparatus comprising:

a mobile frame including a forward portion, a rearward portion including a rear wall, a rear axle located in the rearward portion, a first side and a second side opposite the first side;

an aerial ladder movably mounted relative to the frame so that the aerial ladder can be raised from a generally horizontal stored position to a raised position wherein the aerial ladder extends upwardly at an angle from the frame, the aerial ladder including a waterway extending along the aerial ladder, the waterway including a water outlet;

a turntable to which the aerial ladder is moveably mounted, the turntable being mounted rearward of the rear axle, the turntable being selectively rotatable so that the aerial ladder can be swung to extend beyond at least one of the first side, the second side and the rearward portion of the frame;

a side stack hose bed mounted to the frame in the rearward portion, the side stack hose bed including a floor, a first vertical sidewall and a second vertical sidewall opposite the first vertical sidewall, the side stack hose bed including a front wall joined with the first vertical sidewall and the second vertical sidewall with the floor, the first vertical sidewall, the second vertical sidewall, and the front wall forming a container storing a fire hose, the side stack hose bed having an opening in a rear of the side stack hose bed, opposite the front wall and substantially parallel to the rear wall of the frame, such that the fire hosed stored within the container is deployable through the opening to a rear of the frame;

a first side access ladder including a plurality of steps disposed one over the other mounted to the first side of the frame forward of the side stack hose bed and forward of the rear axle; and a side stack hose bed cover extending over the container when the fire hose is in a stored mode, the side stack hose bed cover being moveable to access the container from a top of the side stack hose bed, the side stack hose bed cover extending generally from the first side access ladder toward the aerial ladder, wherein the first side access ladder and side stack hose bed cover cooperatively form a path from a ground location to at least one of the aerial ladder and the turntable so that a user can step from the first side access ladder toward the side stack hose bed.

17. The aerial firefighting apparatus of claim 16 wherein the side stack hose bed includes a substantially horizontal floor, a first vertical sidewall and a second vertical sidewall opposite the first vertical sidewall, the side stack hose bed including a front wall joined with the first vertical sidewall and the second vertical sidewall, the floor, the first vertical sidewall, the second vertical sidewall, and the front wall forming the container, wherein the first side access ladder is mounted to the frame near the front wall.

18. The aerial firefighting apparatus of claim 16 wherein the turntable includes an access platform attached to the turntable and rotatable therewith, the access platform being selectively positionable adjacent the side stack hose bed cover.

19. The aerial firefighting apparatus of claim 18 comprising a second side access ladder mounted on the second side of the frame, opposite the first side, wherein the second side access ladder is mounted rearward of the rear axle, adjacent a rear corner of the frame.

20. The aerial firefighting apparatus of claim 19 comprising a first locker mounted to the frame forward of the first side access ladder and a second locker mounted to the frame forward of the second side access ladder.

* * * * *